US005411263A

United States Patent [19]

Schmidt et al.

[11] Patent Number: 5,411,263

[45] Date of Patent: * May 2, 1995

[54] GOLF PUTTER WITH BOTTOM RAIL

[75] Inventors: Glenn H. Schmidt, Malibu; Richard C. Helmstetter, Carlsbad, both of Calif.

[73] Assignee: Callaway Golf Company, Carlsbad, Calif.

[ * ] Notice: The portion of the term of this patent subsequent to May 24, 2011 has been disclaimed.

[21] Appl. No.: 246,096

[22] Filed: May 19, 1994

Related U.S. Application Data

[63] Continuation of Ser. No. 8,628, Jan. 28, 1993, Pat. No. 5,314,184.

[51] Int. Cl.[6] ..... A63B 53/02; A63B 53/04

[52] U.S. Cl. ..... 273/164.1; 273/167 A; 273/174; 273/80.2; 273/167 G; 273/80 C

[58] Field of Search ..... 273/167 R, 77 A, 77 R, 273/164.1, 186.1, 186.2, 193 R, 194 R, 194 B, 162 R, 80.1, 80.2, 80 C, 167 A, 174; D21/214, 215, 216, 217, 218, 219, 220

[56] References Cited

U.S. PATENT DOCUMENTS

| | | | |
|---|---|---|---|
| D. 196,734 | 10/1963 | Solheim | D21/217 |
| D. 234,209 | 1/1975 | Bizovi | D21/217 |
| 1,467,714 | 9/1923 | Doerr | 273/168 X |
| 1,517,476 | 12/1924 | Tyler | 273/174 |
| 1,913,821 | 6/1933 | Stumpf | 273/174 |
| 2,174,212 | 9/1939 | Newsome | 273/167 A |
| 3,680,868 | 8/1972 | Jacob | 273/174 |
| 4,000,902 | 1/1977 | Perkins | 273/167 A |
| 4,173,343 | 11/1979 | Richilano . | |
| 4,199,141 | 4/1980 | Skelly | 273/164.1 |
| 4,252,262 | 2/1981 | Igarashi | 273/167 J |
| 4,484,746 | 11/1984 | Brill | 273/167 A |
| 4,498,673 | 2/1985 | Swanson | 273/171 |
| 4,519,612 | 5/1985 | Tsao | 273/167 A |
| 4,671,513 | 6/1987 | Swanson . | |
| 4,712,798 | 12/1987 | Preato | 273/167 A |
| 4,776,594 | 10/1988 | Rango | 273/167 A |
| 4,884,812 | 12/1989 | Nagasaki | 273/167 H |
| 4,960,279 | 10/1990 | Harris, Jr. | 273/164.1 |
| 5,154,423 | 10/1992 | Antonious | 273/167 A |
| 5,314,184 | 5/1994 | Schmidt | 273/164.1 |

*Primary Examiner*—Sebastiano Passaniti
*Attorney, Agent, or Firm*—William W. Haefliger

[57] ABSTRACT

A golf putter for use with a putter shaft supporting a head, the head comprising in combination a putter body having a heel, toe, sole defining a bottom wall, and a ball striking front face, the body elongated between the heel and toe; a control rail projecting downwardly from the bottom wall, the rail being elongated in a direction between the heel and toe to engage the turf as the putter is placed downwardly on a golf green, and in a manner to stabilize the head against twist during the head downward placement, and the rail spaced rearwardly from the front face along the major length of the rail.

17 Claims, 2 Drawing Sheets

GOLF PUTTER WITH BOTTOM RAIL

This is a continuation of application Ser. No. 08/008,628, filed Jan. 28, 1993, now U.S. Pat. No. 5,314,184.

BACKGROUND OF THE INVENTION

This invention relates generally to golf putters, and more particularly to enhancing putter stability when the putter is maneuvered to address and stroke a golf ball on a golf green.

It is commonly found that golf putters tend to twist in response to their placement downwardly on a green in ball addressing position. Such twisting results in mis-alignment of the putter front face relative to the ball, and requires one or more re-alignment adjustments. Putters can also twist during back-swing away from the ball, and forward striking toward and with the ball, one cause of such twisting being putter bottom surface variable engagement with the turf during such swinging and stroking. There is need for improved means to reduce or eliminate these mis-alignment effects, as referred to, as well as need to improve the overall performance of golf putters.

SUMMARY OF THE INVENTION

It is a major object of the invention to provide an improved putter head so constructed as to reduce or eliminate the mis-alignment problem as referred to.

Basically, the improved putter of the present invention comprises, in combination:

a) a putter body having a heel, toe, sole defining a bottom wall, and a ball striking front face, the body elongated between the heel and toe, and b) a control rail projecting downwardly from the bottom wall, the rail being elongated in a direction between the heel and toe to engage the turf as the putter is placed downwardly on a golf green, and in a manner to stabilize the head against twist during the head downward placement, c) the rail spaced rearwardly from said front face along the major length of the rail. Typically, and as will be seen, the control rail has a narrow bottom surface along the rail length, the surface being flat in front to rear direction widthwise of the rail. The bottom surface has substantially uniform width along the majority of the rail length, the rail extending lengthwise below the middle of the putter body between the heel and toe, and extending therefrom toward both the toe and heel.

It is another object of the invention to provide the control rail with a frontward facing surface which tapers downwardly and rearwardly to merge with forward extent of the rail bottom surface and the rail also has a rearward facing surface which tapers downwardly and forwardly to merge with rearward extent of the rail hollow surface. Such surfaces engage the turf in such manner, during head stroking, to result in forces tending to elevate the head to prevent digging of the putter into the turf; and such surfaces typically extend equidistantly toward the toe and heel, from the said region of the head and rail, so that twisting forces due to turf engagement are counter balanced.

Yet another object is to provide a rail as referred to, which is curved, i.e. extends in a curved plane along the rail length, thereby to provide turf engaging rail support points that are not all in a line, so that stability against tilt of the head results from rail biting into the turf as the head is placed downwardly in position, addressing the ball.

A further object includes the provision of an L-shaped putter head wherein the putter shaft receiving bore extends downwardly through the head, to intersect the rail, near the front face of the head, for enhanced head positioning control and head stability, during addressing of the ball and stroking of the head.

These and other objects and advantages of the invention, as well as the details of an illustrative embodiment, will be more fully understood from the following specification and drawings, in which:

DRAWING DESCRIPTION

DETAILED DESCRIPTION

Figure 1:
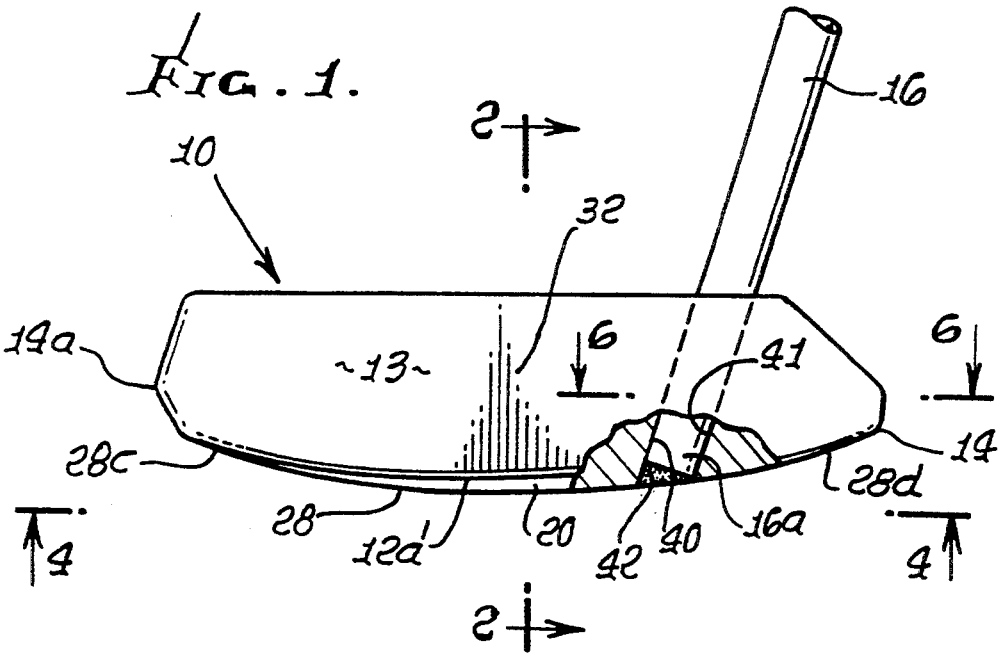
FIG. 1 is a frontal elevation showing a putter head incorporating the invention.

In the drawings, the putter head 10 has a body 11 defining a sole 12, front ball striking face or surface 13, heel 14, and toe 14*a*. A shaft 16 is connected to the body, and extends upwardly, as shown. The head may be metallic, and typically consists of brass. The body is elongated between the heel and toe, as shown.

Figure 2:
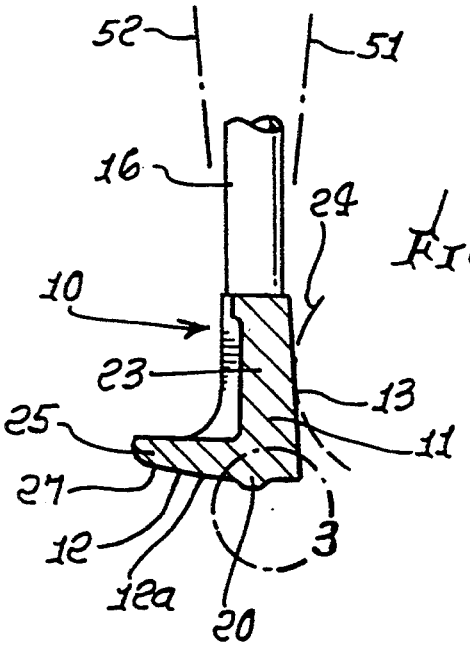
FIG. 2 is a section taken on lines 2—2 of FIG. 1.
Figure 3:
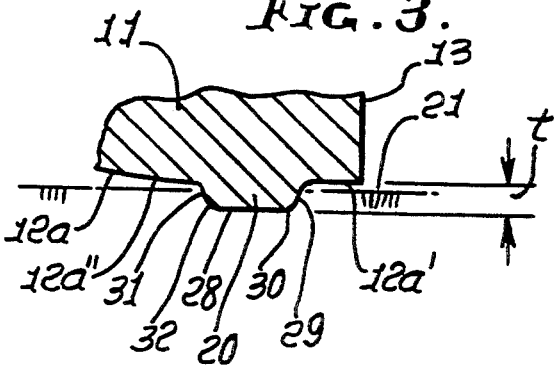
FIG. 3 is an enlarged fragmentary section, taken on lines 3—3 of FIG. 2.

In accordance with the invention, a rail 20 projects downwardly from the bottom wall 12*a* of the sole, the rail 20 being elongated in a direction between the heel and toe to engage the turf 21 of the putting green and projects downwardly into the turf, as shown in FIG. 3, in a manner to stabilize the head for resisting twist as in either or both twist directions (indicated by arrows 22 and 23 in FIG. 4) as the putter sole is placed downwardly, on the green turf. See also the golf ball 24 in FIG. 2, immediately in front of face 13, the rail received in the turf tending to maintain the head face 13 squared relative to the ball, just prior to stroking of the head by manual swing of the shaft 16.

As shown, the elongated rail is spaced rearwardly from the front face 13, beneath the upright head front flange 23, for substantially balanced support of the head. The head is L-shaped in cross section (see FIG. 2), and has a bottom and rearward flange 25 projecting rearwardly from lower extent of 23, to define the sole bottom wall 12*a*. The bottom includes bottom wall extent 12*a*′ frontwardly of the rail, and bottom wall extent 12*a*″ rearwardly of the rail. In the example, the front to rear width $w_1$, of 12*a*′ is substantially less than the front to rear width $w_2$ of 12*a*″ and typically, $w_2$, is two to six times $w_1$Bottom wall extent 12*a*′ is typically flat in a front to rear direction, and shallowly downwardly convex in a heel to toe direction (see FIG. 1); and bottom wall extent 12*a*″ is typically flat but slightly beveled upwardly and rearwardly at 27, in a front to rear direction, and 12*a*′ is also shallowly downwardly convex, as in FIG. 1.

Rail 20 has a bottom surface 28 extending along the rail length, that surface typically having constant, or substantially constant width, and being flat or substantially flat in a front to rear direction, widthwise of the rail. Such width should be between $\frac{1}{8}$ and $\frac{3}{8}$ inches, and the rail should project below the sole surface by an amount "t" where t decreases toward the toe, and toward the heel along the rail length (see FIG. 1). The maximum amount "t" should be between 1/16 and $\frac{1}{8}$ inch, so as to effectively seat into the green turf, without extending too deeply into the turf so as to impede head stroking. Rail bottom surface 28 has greater curvature, than the curvature of sole 12 in a toe to heel direction to merge with the sole at 28*c* and 28*d*.

Further, the rail 20 has frontwardly facing surface 29 which tapers downwardly and rearwardly (see FIG. 3) so as to slide over the turf as the head is stroked, the impact of the turf against the tapered surface 29 tending to lift the putter head and prevent or minimize digging of the head further into the turf as the head is stroked. Surface 29 merges with surface 28 along a rounded edge 30, to enhance these effects.

Likewise, the rail 20 has a rearwardly facing surface 31 which tapers downwardly and forwardly (see FIG. 3) to merge with surface 28 along a rounded edge 32. Surfaces 31 and 32 enable rearward sliding of the putter over the green turf as the head is swung backwardly relative to the golf ball, tending to prevent or minimize digging of the head into the turf during the back-stroke.

Note that the rail middle extent extends lengthwise below the middle of the putter, i.e. the "sweet spot" region 32 directly rearwardly of the ball; also the rail extends from that middle extent toward the heel and toward the toe to equal, or substantially equal extents, whereby rail engagement with the turf during the back and forward strokes is the same toward the toe and toward the heel (from the rail middle extent) to minimize twisting of the putter head as it is stroked.

Figure 4:
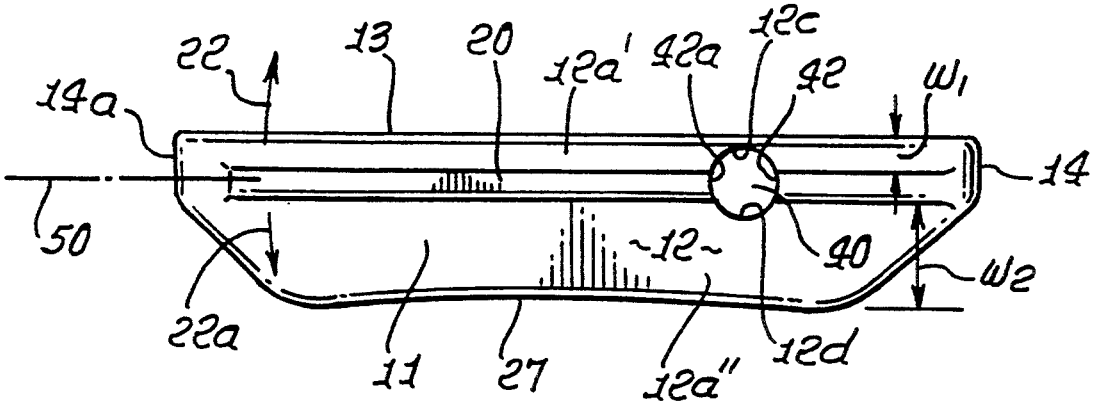
FIG. 4 is a bottom plan view taken on lines 4—4 of FIG. 1.

In FIGS. 1, 2 and 4, the putter shaft 16 is affixed to the body 11 to project downwardly toward the rail, where weight is downwardly concentrated for transfer to the turf. The body 11 defines or contains a shaft receiving bore 40 wherein the shaft lower end 16*a* is joined to the bore as by adhesive, at 41. The bore intersects the bottom surface of the rail at spaced arcuate locations 42 and 42*a*, and the sole 12 at arcuate locations 12*c* and 12*d*, as seen in FIGS. 1 and 4, and the shaft end may also extend almost to the rail bottom surface between the heel and the mid region of the rail. Filler 48 fills space between the lower core of the shaft and the surfaces 12 and 28. Note that bore 40 extends in the upright front flange 23, and the shaft extends upwardly from that bore.

Figure 5:
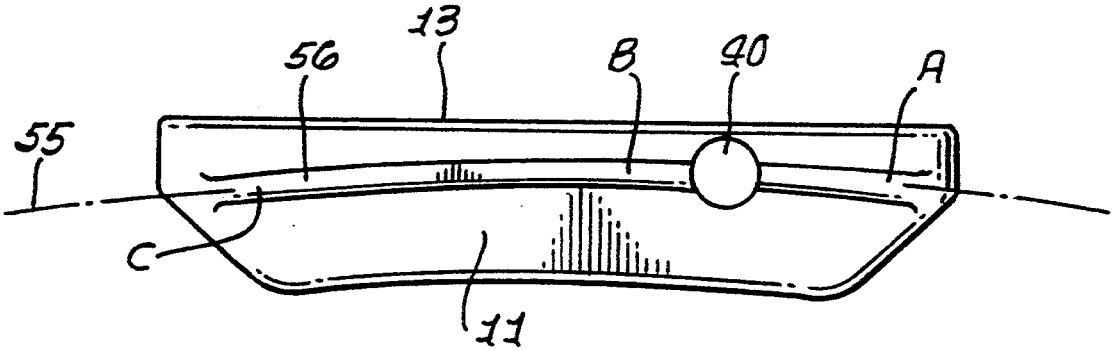
FIG. 5 is a view like FIG. 4, showing a modification.

It will be noted that in FIGS. 1–4, the rail lengthwise extent defines a flat upright plane 50 extending between the toe and heel. See FIG. 4. Such a straight rail allows some pivoting or tilting of the head forwardly or rearwardly, as indicated by lines 51 and 52 in FIG. 2. To eliminate or reduce such capacity for tilting, i.e. to help maintain the head in upright position as seen in FIG. 2, with face 13 squarely addressing the ball, the rail is formed to be lengthwise curved, to provide enhanced support for the putter body on the turf—i.e. "3-point" support, in effect. See for example the curved plane 55 of the rail 56 in FIG. 5, and such curvature may take various forms. Three points of support, out of alignment, are seen at A, B and C, in FIG. 5. Such a rail 56, otherwise like the above described rail 20, provides all of the advantages of rail 20, plus the added, anti-pivot support for the putter body as described. Note that the front inclined surface of rail 56 has variable spacing from the ball striking surface 13 of the putter head.

Figure 6:
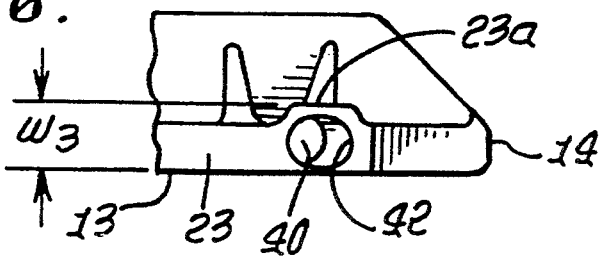
FIG. 6 is a fragmentary plan view taken on lines 6—6 of FIG. 1.

In FIG. 6, the flange 23 is locally enlarged, rearwardly, at 23*a*, to provide a total front to rear thickness $w_3$ greater than bore 40 diameter.

We claim:

1. A golf putter for use with a putter shaft supporting a head, the head comprising, in combination:

a) a putter body having a heel, toe, sole defining a bottom wall, and a ball striking front face, the body elongated between the heel and toe, and b) a control rail projecting downwardly from said bottom wall, the rail being elongated in a direction between the heel and toe to engage the turf as the putter is placed downwardly on a golf green, and in a manner to stabilize the head against twist during said head downward placement, c) said rail spaced rearwardly from said front face along the major length of the rail, d) the rail having a depth which decreases toward at least one of the toe and heel.

2. The combination of claim 1 wherein the rail has a narrow bottom surface along the rail length, said surface being flat in a front to rear direction widthwise of the rail.

3. The combination of claim 2 wherein the rail has a frontward facing surface which tapers downwardly and rearwardly to merge with a forward extent of said rail bottom surface, and the rail also has a rearward facing surface which tapers downwardly and forwardly to merge with a rearward extent of said rail narrow surface.

4. The combination of claim 2 wherein said bottom surface has a substantially uniform width along the majority of the rail length, the rail extending lengthwise below the middle of the putter body between the heel and toe, and extending therefrom toward both the toe and heel.

5. The combination of claim 4 wherein said width is between $\frac{1}{8}$ inch and $\frac{3}{8}$ inch.

6. The combination of claim 1 wherein the rail defines a flat upright plane which extends between the toe and heel.

7. The combination of claim 6 wherein said flat bottom surface is downwardly convex along said length in a direction between the heel and toe.

8. The combination of claim 1 wherein the rail defines a curved upright plane which extends between the toe and heel, whereby the rail bottom surface is lengthwise curved to provide anti-tilt body support on the turf.

9. The combination of claim 8 wherein said rail flat bottom surface is downwardly convex along the said length in a direction between the heel and toe.

10. The combination of claim 9 wherein the body defines a shaft bore intersecting the rail, and a shaft extending downwardly in said bore and affixed thereto.

11. The combination of claim 10 wherein the rail is spaced rearwardly from said head front face, and said shaft extends upwardly from said bore, the shaft bore also intersecting the sole, and said sole also being downwardly convex along its length between the heel and toe, the rail having a depth which decreases toward the toe and toward the heel.

12. The combination of claim 9 wherein the body defines a shaft bore above the rail, and a shaft extending downwardly in said bore and affixed thereto.

13. The combination of claim 12 wherein the rail is spaced rearwardly from said head front face, and said shaft extends upwardly from said bore in spaced relation to the rail, the rail having a depth which decreases toward both toe and the heel.

14. The combination of claim 1 wherein the rail has a maximum projection of less than ¼ inch below said sole bottom surface, along the rail length.

15. The combination of claim 1 wherein the putter body is metallic.

16. The combination of claim 15 wherein the putter body has L-shaped cross sections in upright planes normal to the length direction of the rail, the rail projecting below said L-shaped cross sections.

17. The combination of claim 1 including a putter shaft affixed to said body to project downwardly toward said rail.

* * * * *